US011506995B2

(12) United States Patent
Kuramoto et al.

(10) Patent No.: US 11,506,995 B2
(45) Date of Patent: Nov. 22, 2022

(54) DEVELOPING DEVICE AND IMAGE FORMING APPARATUS

(71) Applicant: FUJIFILM Business Innovation Corp., Tokyo (JP)

(72) Inventors: Shinichi Kuramoto, Kanagawa (JP); Tomoyuki Yoshii, Kanagawa (JP); Norihiro Tamazawa, Kanagawa (JP); Yoshifumi Ozaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 6 days.

(21) Appl. No.: 17/321,489

(22) Filed: May 16, 2021

(65) Prior Publication Data

US 2022/0019158 A1 Jan. 20, 2022

(30) Foreign Application Priority Data

Jul. 14, 2020 (JP) ..... JP2020-120984

(51) Int. Cl.
*G03G 15/08* (2006.01)

(52) U.S. Cl.
CPC ..... *G03G 15/0891* (2013.01); *G03G 15/0812* (2013.01)

(58) Field of Classification Search
CPC ..... G03G 15/0891; G03G 15/0812
See application file for complete search history.

(56) References Cited

U.S. PATENT DOCUMENTS 6,813,462 B2 * 11/2004 Mitsuya ..... G03G 15/09 399/269
6,941,098 B2 * 9/2005 Miyaguchi ..... G03G 15/08 399/252
7,466,946 B2 * 12/2008 Tsujita ..... G03G 15/0812 399/269
8,953,989 B2 * 2/2015 Funada ..... G03G 15/081 399/269
2008/0240793 A1 * 10/2008 Kobayashi ..... G03G 15/0921 399/267
2009/0290913 A1 * 11/2009 Itagaki ..... G03G 15/0921 399/277

FOREIGN PATENT DOCUMENTS

JP 2011221445 11/2011

* cited by examiner

*Primary Examiner* — Walter L Lindsay, Jr.
*Assistant Examiner* — Milton Gonzalez
(74) *Attorney, Agent, or Firm* — JCIPRNET

(57) ABSTRACT

A developing device includes a transporting member that transports a developer in an axial direction while rotating, a developing unit that hands over the developer to an image holder, on which an electrostatic latent image is formed, while rotating, and develops the electrostatic latent image, a pumping unit that has a rotation member rotating in a circumferential direction, pumps the developer transported by the transporting member with a magnetic force, and supplies the pumped developer to the developing unit by releasing the developer in a tangential direction of the rotating rotation member, and a changing unit that changes a flowing direction of the developer, which is released in the tangential direction of the rotating rotation member and is to be supplied to the developing unit.

11 Claims, 11 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2020-120984 filed Jul. 14, 2020.

BACKGROUND

(i) Technical Field

The present invention relates to a developing device and an image forming apparatus.

(ii) Related Art

A developing device described in JP2011-221445A includes a mixing transport unit that transports a developer while mixing, a developing roller that is arranged to face an image carrier and carries and transports the developer to a developing region, a developer supply roller that supplies the developer from the mixing transport unit to the developing roller, a developer supply space forming portion that has a curved surface keeping a predetermined distance to the surface of the developer supply roller and forms a space, which is a gap being the predetermined distance between the curved surface and the surface of the developer supply roller, as a developer supply space, and a guide member that guides the developer from the developer supply roller to the developing roller and provides a developer rectifying space accommodating a predetermined amount of developer.

SUMMARY

The developing device includes a transport auger that transports the developer in an axial direction while rotating, the developing roller that hands over the developer to an image holder, on which an electrostatic latent image is formed, and develops the electrostatic latent image, and a pumping roller that pumps the developer transported by the transport auger and supplies the developer to the developing roller. The pumping roller has a columnar magnet roller and a rotation member, into which the magnet roller is inserted and which rotates in a circumferential direction.

In the related art, the developer released from the rotation member of the rotating pumping roller in a tangential direction of the rotation member is supplied to the surface of the developing roller without a flowing direction thereof being changed forcibly. However, in such a configuration, in a case where the amount of developer pumped by the pumping roller varies in an axial direction of the developing roller, the amount of developer supplied from the pumping roller (pumping unit) to the developing roller (developing unit) also varies in the axial direction. For this reason, in a case where the electrostatic latent image is developed, development unevenness in the axial direction of the developing roller occurs in some cases.

An object of the present invention is to suppress development unevenness that occurs in the axial direction of the developing unit without forcibly changing the flowing direction of the developer released from the rotation member of the rotating pumping unit in the tangential direction of the rotation member, compared to a case of being supplied to the developing unit.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including a transporting member that transports a developer in an axial direction while rotating, a developing unit that hands over the developer to an image holder, on which an electrostatic latent image is formed, while rotating, and develops the electrostatic latent image, a pumping unit that has a rotation member rotating in a circumferential direction, pumps the developer transported by the transporting member with a magnetic force, and supplies the pumped developer to the developing unit by releasing the developer in a tangential direction of the rotating rotation member, and a changing unit that changes a flowing direction of the developer, which is released in the tangential direction of the rotating rotation member and is to be supplied to the developing unit.

BRIEF DESCRIPTION OF THE DRAWINGS

Exemplary embodiment(s) of the present invention will be described in detail based on the following figures, wherein.

DETAILED DESCRIPTION

Figure 1:
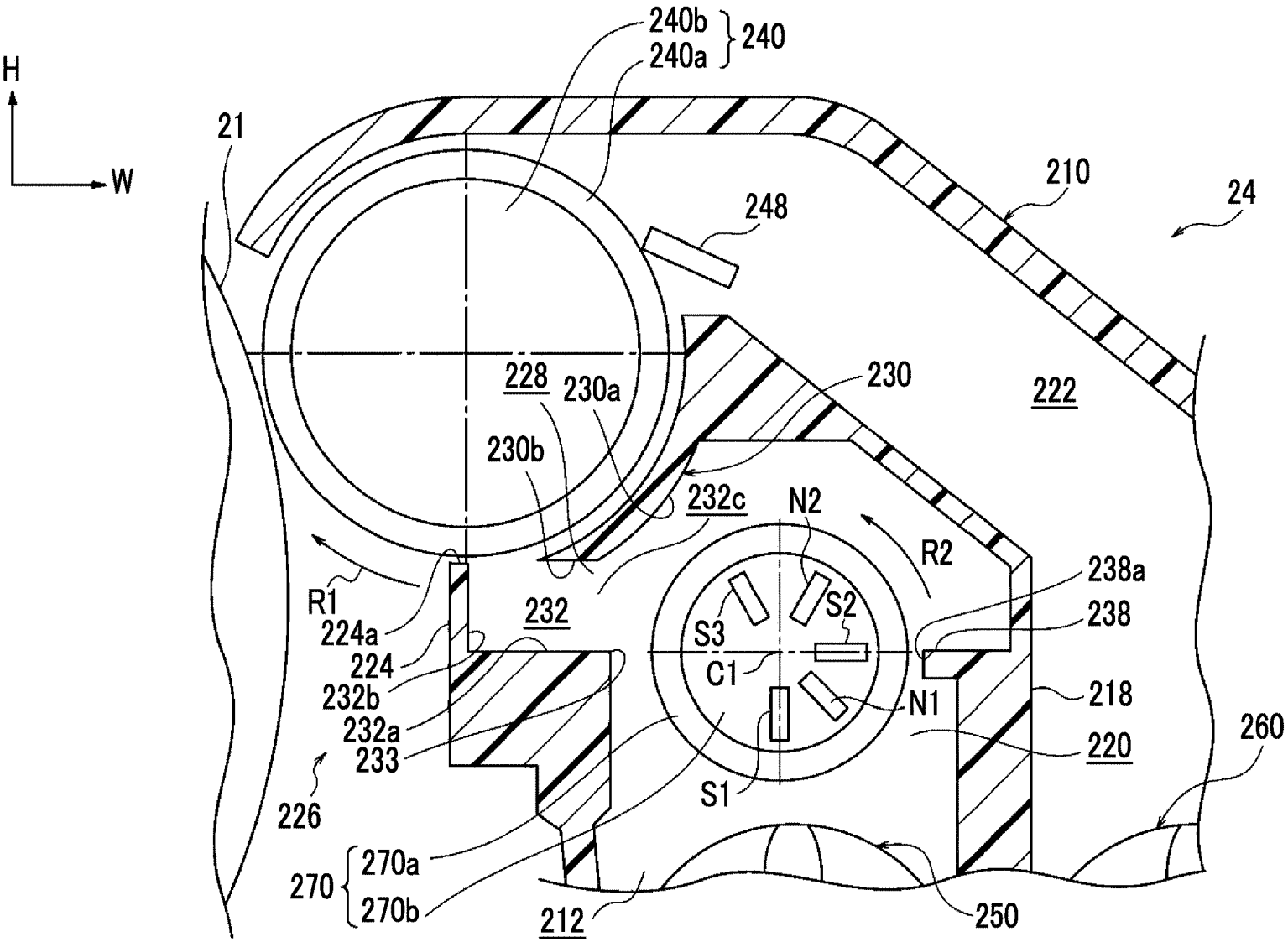
FIG. 1 is an enlarged sectional view illustrating a developing device according to an exemplary embodiment of the present invention.

Examples of a developing device and an image forming apparatus according to an exemplary embodiment of the present invention will be described with reference to FIGS.

1 to 11. An arrow H shown in the drawings indicates an apparatus up-and-down direction (vertical direction), an arrow W indicates an apparatus width direction (horizontal direction), and an arrow D indicates an apparatus depth direction (horizontal direction).

Image Forming Apparatus 10

Figure 9:
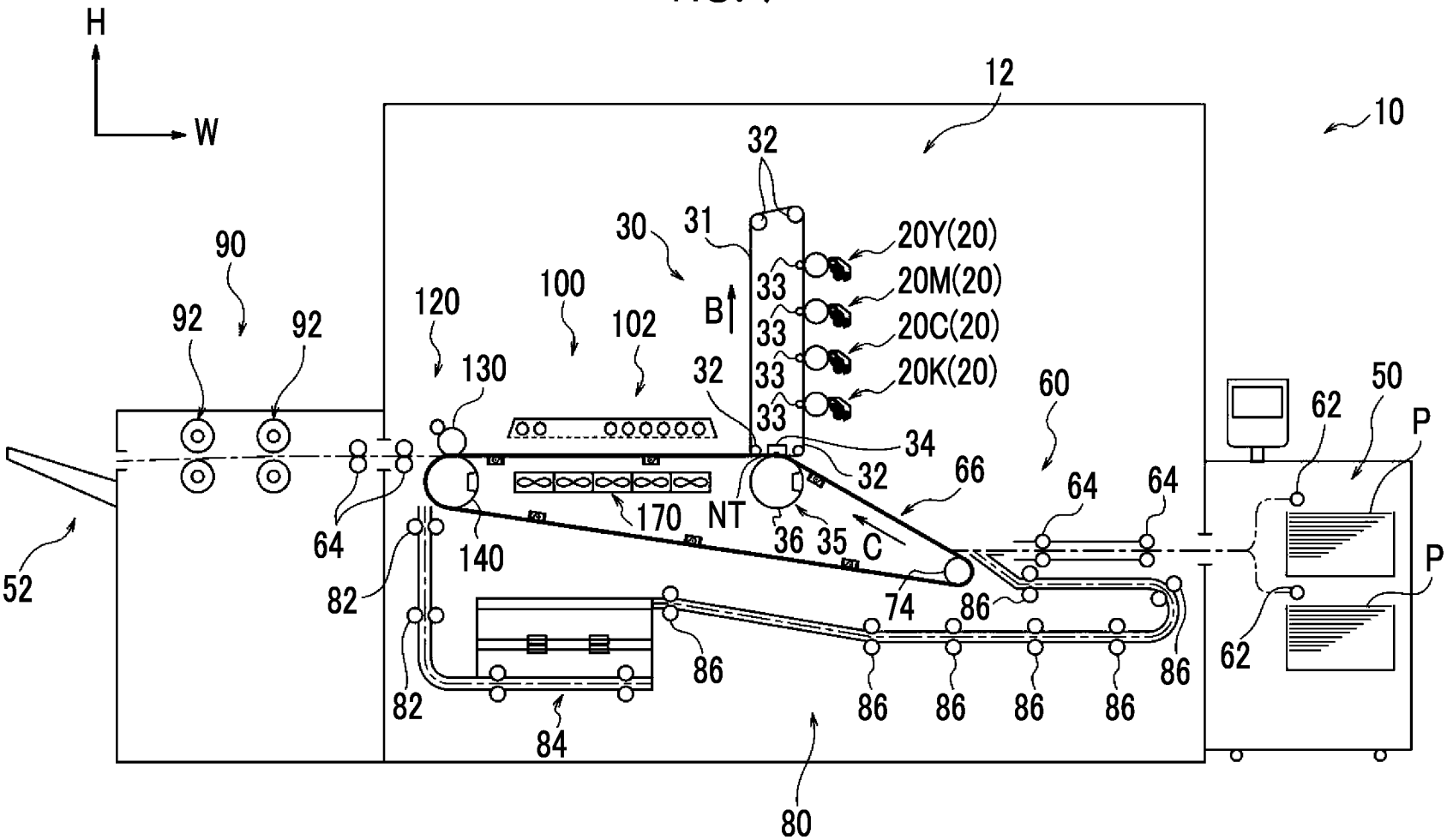
FIG. 9 is a schematic configuration view illustrating the image forming apparatus according to the exemplary embodiment of the present invention.

An image forming apparatus 10 according to the present exemplary embodiment is an image forming apparatus that forms an image on a sheet member P, which is a recording medium. Specifically, the image forming apparatus 10 is an electrophotographic image forming apparatus that forms a toner image on the sheet member P. As illustrated in FIG. 9, the image forming apparatus 10 includes an accommodating portion 50, a discharge portion 52, an image forming unit 12, a transporting mechanism 60, an inverting mechanism 80, a fixing device 100, and a cooling unit 90.

Accommodating Portion 50

The accommodating portion 50 has a function of accommodating the sheet member P. The image forming apparatus 10 includes a plurality of (for example, two) accommodating portions 50 as illustrated in FIG. 9. A configuration where the sheet member P is selectively sent out from the plurality of accommodating portions 50 is adopted.

Discharge Portion 52

As illustrated in FIG. 9, the discharge portion 52 is a portion to which the sheet member P, on which an image is formed, is discharged. Specifically, a configuration where, after the image is fixed by the fixing device 100, the sheet member P cooled by the cooling unit 90 is discharged to the discharge portion 52 is adopted.

Image Forming Unit 12

The image forming unit 12 is an example of an image forming unit that forms an image on the sheet member P. Specifically, the image forming unit 12 has a function of forming an image on the sheet member P through an electrophotographic image method as illustrated in FIG. 9. More specifically, the image forming unit 12 includes a toner image forming unit 20 that forms a toner image and a transfer device 30 that transfers the toner image, which is formed by the toner image forming unit 20, to the sheet member P.

A plurality of toner image forming units 20 are included to form a toner image for each color. The image forming apparatus 10 includes the toner image forming units 20 of, in total, four colors including yellow (Y), magenta (M), cyan (C), and black (K). (Y), (M), (C), and (K) shown in FIG. 9 indicate components corresponding to the colors respectively.

Toner Image Forming Unit 20

Figure 6:
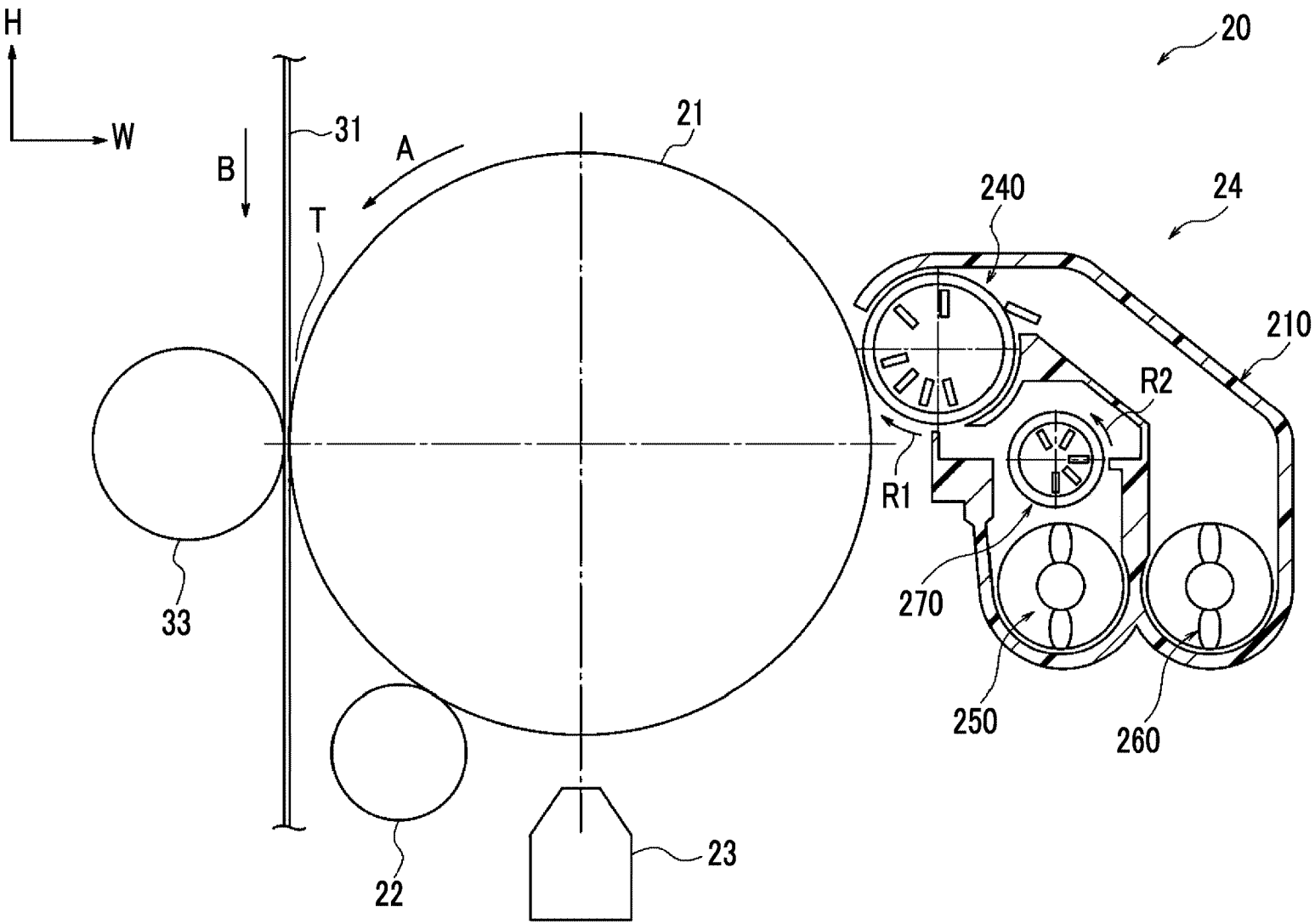
FIG. 6 is a configuration view illustrating a toner image forming unit of an image forming apparatus according to the exemplary embodiment of the present invention.

The toner image forming unit 20 of each color is basically configured the same except for a toner to be used. Specifically, the toner image forming unit 20 of each color includes an image holder 21 (photoreceptor) that rotates in an arrow A direction of FIG. 6 and a charger 22 that charges the image holder 21, as illustrated in FIG. 6. Further, the toner image forming unit 20 of each color includes an exposure device 23 that exposes the image holder 21 charged by the charger 22 to form an electrostatic latent image on the image holder 21 and a developing device 24 that develops the electrostatic latent image, which is formed on the image holder 21 by the exposure device 23, using a toner. Details of the developing device 24 will be described later.

Transfer Device 30

The transfer device 30 has a function of primarily transferring toner images which are on the image holders 21 of respective colors through superimposition on an intermediate transfer body and secondarily transferring the superimposed toner image to the sheet member P. Specifically, the transfer device 30 includes a transfer belt 31, which is an intermediate transfer body, a primary transfer roller 33, and a transfer unit 35, as illustrated in FIG. 9.

The primary transfer roller 33 has a function of transferring a toner image formed on the image holder 21 to the transfer belt 31 at a primary transfer position T (refer to FIG. 6) between the image holder 21 and the primary transfer roller 33.

The transfer belt 31 has an endless belt shape, and a posture thereof is determined by being wound around a plurality of rollers 32. As at least one of the plurality of rollers 32 is rotationally driven, the transfer belt 31 goes around in an arrow B direction, and an image primarily transferred is transported to a secondary transfer position NT.

The transfer unit 35 has a function of transferring a toner image, which is transferred on the transfer belt 31, to the sheet member P. Specifically, the transfer unit 35 includes a secondary transfer unit 34 and a facing roller 36.

The facing roller 36 is arranged below the transfer belt 31 to face the transfer belt 31. The secondary transfer unit 34 is arranged inside of the transfer belt 31 such that the transfer belt 31 is arranged between the facing roller 36 and the secondary transfer unit. Specifically, the secondary transfer unit 34 is configured by a corotron. With the transfer unit 35, a toner image transferred to the transfer belt 31 is transferred to the sheet member P passing through the secondary transfer position NT due to an electrostatic force generated by discharge of the secondary transfer unit 34.

Transporting Mechanism 60

The transporting mechanism 60 is a mechanism that transports the sheet member P. Specifically, the transporting mechanism 60 has a function of transporting the sheet member P accommodated in the accommodating portion 50 to the secondary transfer position NT, as illustrated in FIG. 9. Further, the transporting mechanism 60 has a function of transporting the sheet member from the secondary transfer position NT to a fixing unit 120 (a pressurizing roller 140 and a heating roller 130 which are to be described later) to be described later. In other words, the transporting mechanism 60 has a function of transporting the sheet member P, to which a toner image is transferred, toward the fixing unit 120.

Specifically, the transporting mechanism 60 includes a sending roller 62, a plurality of transporting rollers 64, and a chain gripper 66.

The sending roller 62 is a roller that sends out the sheet member P accommodated in the accommodating portion 50. The plurality of transporting rollers 64 each are a roller that transports the sheet member P sent out by the sending roller 62 to the chain gripper 66 or a roller that transports the sheet member P transported by the chain gripper 66 to the cooling unit 90.

Figure 8:
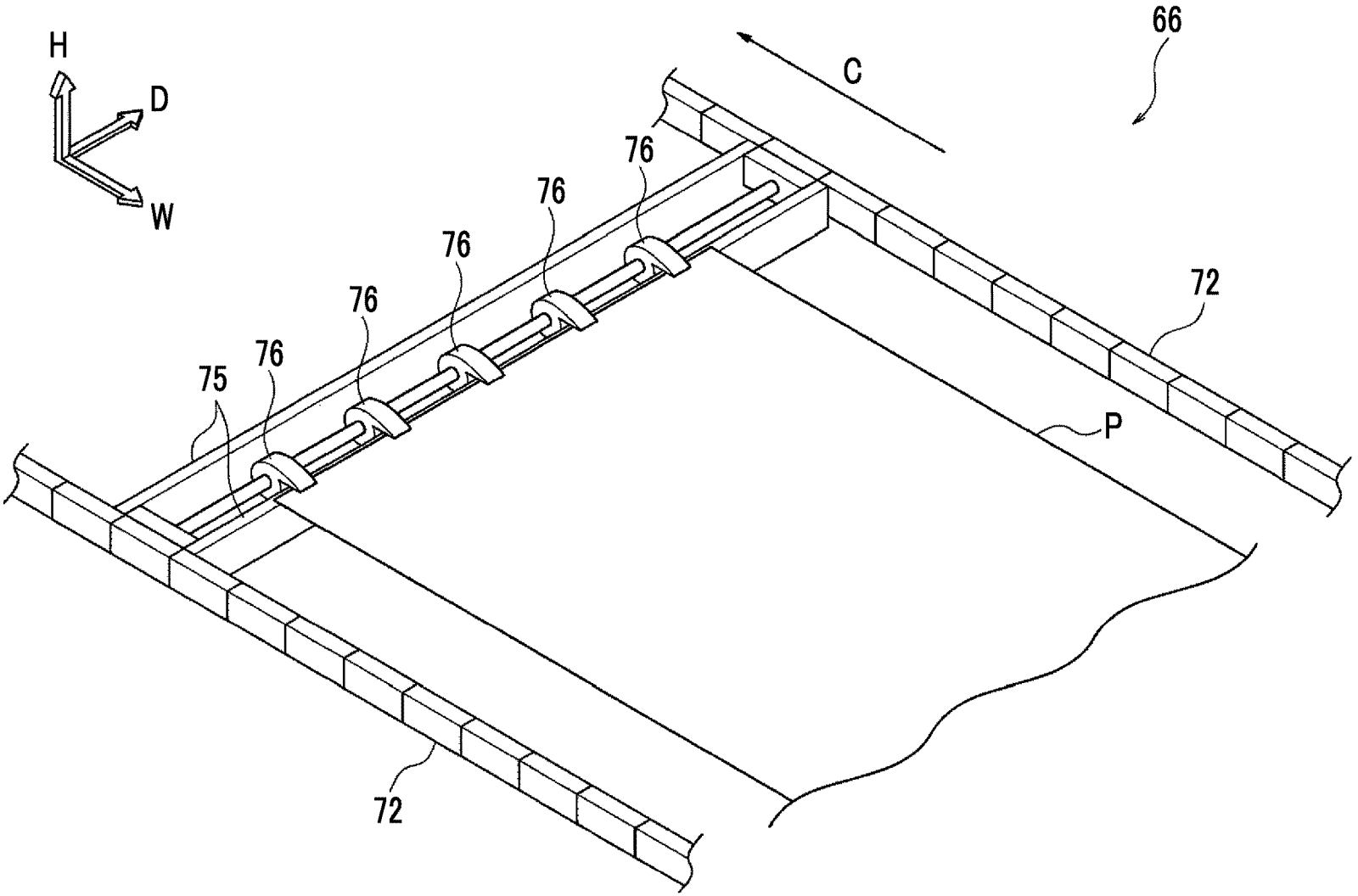
FIG. 8 is a configuration view illustrating a chain gripper of the image forming apparatus according to the exemplary embodiment of the present invention.

The chain gripper 66 has a function of holding a leading end side of the sheet member P and transporting the sheet member P. Specifically, the chain gripper 66 has a pair of chains 72 and a plurality of grippers 76 that hold a portion of the leading end side of the sheet member P, as illustrated in FIG. 8.

The pair of chains 72 is wound around a pair of sprockets (not illustrated) arranged on one end side and the other end side in an axial direction of the facing roller 36, a pair of sprockets (not illustrated) arranged on one end side and the other end side in an axial direction of the pressurizing roller 140 to be described later, and a pair of sprockets 74 (refer to FIG. 9) arranged at an interval in the apparatus depth direction. The chains 72 are configured to go around in an arrow C direction as any one of the pairs of sprockets rotates.

Amounting member 75 on which the grippers 76 are mounted is hung on the pair of chains 72 along the apparatus depth direction. A plurality of mounting members 75 are provided, and are fixed to the pair of chains 72 at an interval determined in advance along a circumferential direction (going-around direction) of the chains 72. The plurality of grippers 76 are provided, and are mounted on the mounting members 75 at an interval determined in advance along the apparatus depth direction.

Then, the sheet member P is transported as the chains 72 go around in the arrow C direction in a state where the grippers 76 hold a leading end portion of the sheet member P.

Inverting Mechanism 80

The inverting mechanism 80 is a mechanism that inverts the front and back of the sheet member P. Specifically, as illustrated in FIG. 9, the inverting mechanism 80 includes a plurality of (for example, two) transporting rollers 82, an inverting device 84, and a plurality of (for example, seven) transporting rollers 86.

The plurality of transporting rollers 82 each are a roller that transports the sheet member P sent from the fixing device 100 to the inverting device 84. For example, the inverting device 84 is a device that twists the sheet member P like a Mobius strip by transporting the sheet member P while folding back the sheet member a plurality of times such that a direction in which the sheet member P is transported changes by, for example, 90 degrees, and thereby inverts the front and back of the sheet member P.

The plurality of transporting rollers 86 each are a roller that transports the sheet member P, of which the front and back is inverted by the inverting device 84, to the chain gripper 66.

Apart of a transport path through which the sheet member P is transported by the inverting mechanism 80 is indicated by a one-dot chain line. In addition, the inverting mechanism 80 may be a mechanism that inverts the sheet member P by switching back the sheet member.

Fixing Device 100

Figure 7:
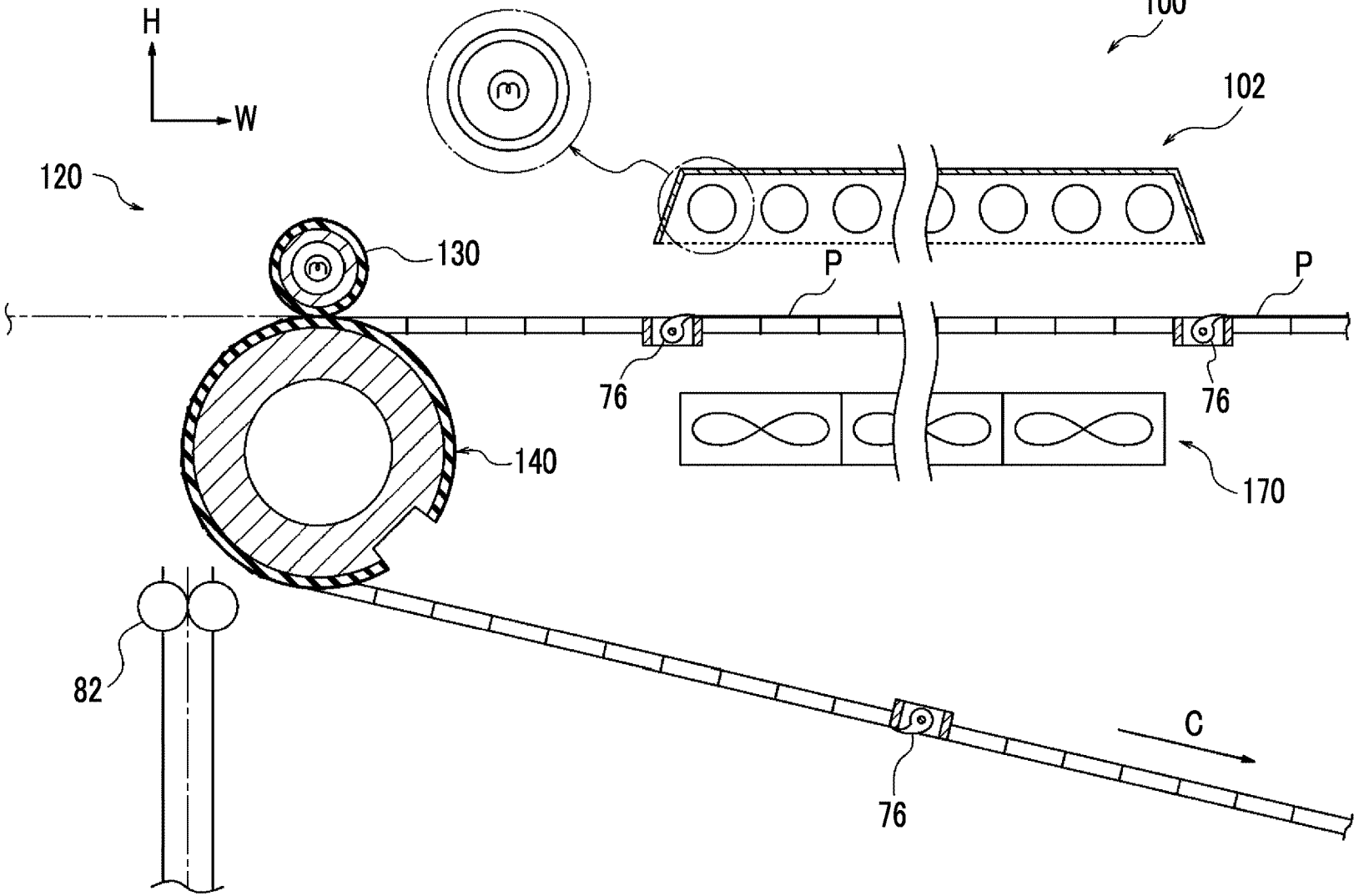
FIG. 7 is a configuration view illustrating a fixing device of the image forming apparatus according to the exemplary embodiment of the present invention.

The fixing device 100 has a function of fixing a toner image, which is transferred to the sheet member P by the transfer device 30, to the sheet member P. As illustrated in FIG. 7, the fixing device 100 includes a heating unit 102 that heats the transported sheet member P in a non-contact state with the sheet member P and a blowing unit 170 that blows air to support the sheet member P and stabilizes the posture of the sheet member P. Further, the fixing device 100 includes the fixing unit 120 that heats and pressurizes the sheet member P by coming into contact with the sheet member.

The fixing unit 120 includes the heating roller 130 that heats the sheet member P by coming into contact with the transported sheet member P and the pressurizing roller 140 that pressurizes the sheet member P toward the heating roller 130.

Cooling Unit 90

The cooling unit 90 has a function of cooling the sheet member P heated by the fixing device 100. As illustrated in FIG. 9, the cooling unit 90 includes two cooling rollers 92 arranged in the apparatus width direction. Since the two cooling rollers 92 have the same configuration, one cooling roller 92 will be described.

An air flow generated by a blowing mechanism (not illustrated) is generated inside the cooling roller 92. Due to this air flow, the temperature of the surface of the cooling roller 92 is lower than the temperature in a case where this air flow is not generated.

Action of Image Forming Apparatus

The image forming apparatus 10 forms an image as follows.

First, the charger 22 (refer to FIG. 6) of each color, to which a voltage is applied, uniformly negatively charges the surface of the image holder 21 of each color at a planned potential. Next, based on externally input image data, the exposure device 23 irradiates the charged surface of the image holder 21 of each color with exposure light and forms an electrostatic latent image.

Accordingly, the electrostatic latent image corresponding to the image data is formed on the surface of each image holder 21. Further, the developing device 24 of each color develops the electrostatic latent image, and visualizes the electrostatic latent image as a toner image. In addition, the transfer device 30 transfers the toner image, which is formed on the surface of the image holder 21 of each color, to the transfer belt 31.

Thus, the sheet member P that is send out from the accommodating portion 50 illustrated in FIG. 9 by the sending roller 62 to the transport path of the sheet member P and is transported by the chain gripper 66 is sent out to the secondary transfer position NT where the transfer belt 31 and the facing roller 36 come into contact with each other. As the sheet member P is transported while being sandwiched between the transfer belt 31 and the facing roller 36 at the secondary transfer position NT, the toner image on the surface of the transfer belt 31 is transferred to the surface of the sheet member P.

Further, the fixing device 100 fixes the toner image, which is transferred to the surface of the sheet member P, to the sheet member P, and the sheet member P is transported to the cooling unit 90. The cooling unit 90 cools the sheet member P, to which the toner image is fixed, and discharges the sheet member to the discharge portion 52.

On the other hand, in a case of forming a toner image on the back surface of the sheet member P, the sheet member P that has passed through the fixing device 100 by being transported by the chain gripper 66 is transported to the transporting rollers 82 of the inverting mechanism 80, and the front and back of the sheet member P transported by the transporting rollers 82 is inverted by the inverting device 84. Further, the transporting rollers 86 transport the sheet member P, of which the front and back is inverted, to the chain gripper 66. The chain gripper 66 transports the sheet member P. Then, the steps described above are performed again in order to form the toner image on the back surface of the sheet member P.

Major Portion Configuration

Next, the developing device 24 will be described.

Figure 3:
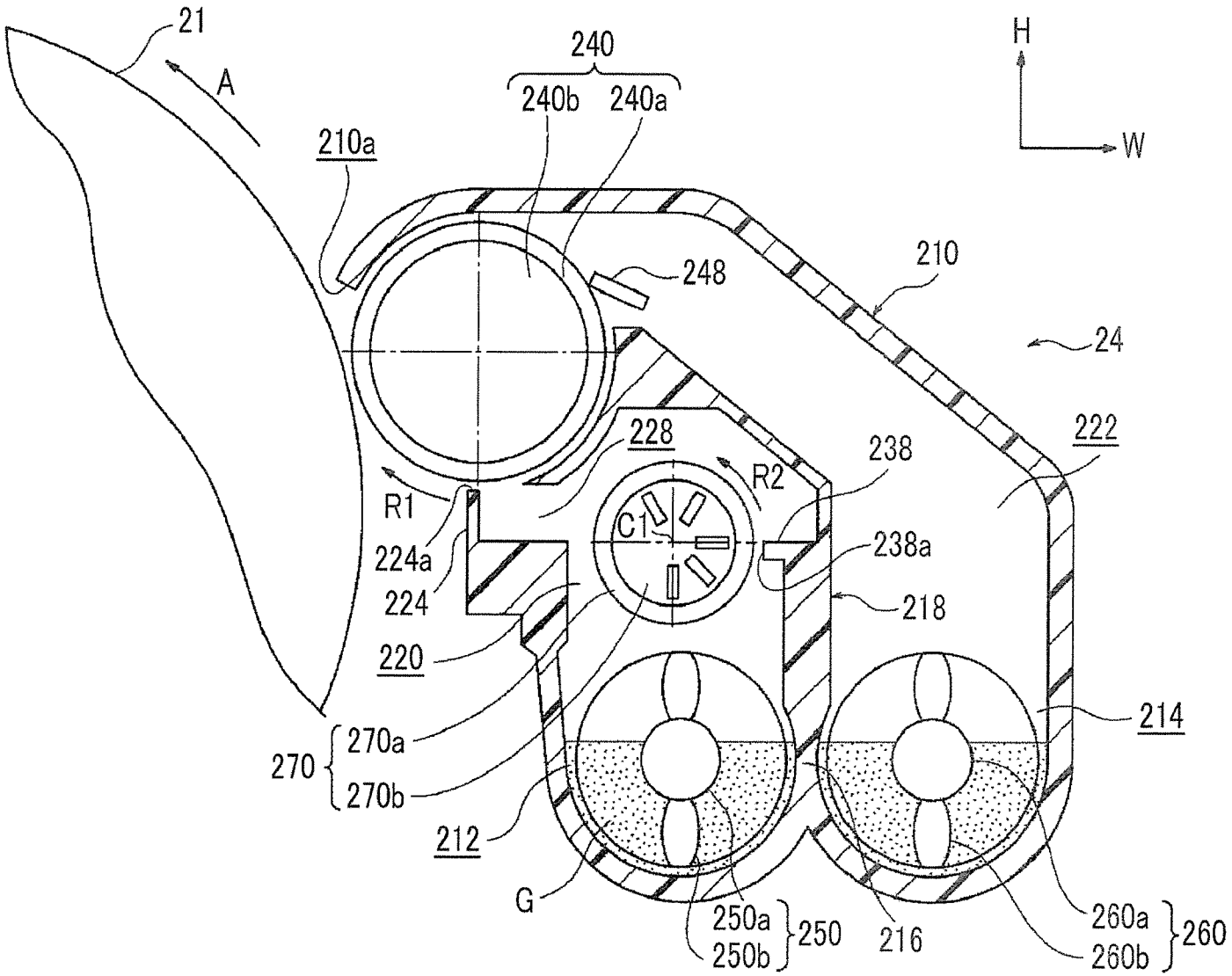
FIG. 3 is a sectional view illustrating the developing device according to the exemplary embodiment of the present invention.

As illustrated in FIG. 3, the developing device 24 includes a housing 210, a developing roller 240, a scraping blade 248, a supply auger 250, a mixing auger 260, and a pumping roller 270. In addition, a developer G containing a toner T and a carrier C is accommodated inside the housing 210. The developing roller 240 is an example of a developing unit, the supply auger 250 is an example of a transporting member, and the pumping roller 270 is an example of a pumping unit.

Housing 210

As illustrated in FIG. 3, an opening portion 210*a* that is open toward an image holder 21 side is formed in an upper portion of the housing 210. The developing roller 240 that hands over the developer G to the image holder 21 is accommodated inside the housing 210 such that a part thereof is exposed from the opening portion 210*a* and an axial direction thereof is set to the apparatus depth direction.

Further, a supply path 212, through which the developer G to be supplied to the developing roller 240 via the pumping roller 270 is transported, and a mixing path 214, through which the developer G is transported while being mixed, are formed in a lower portion of the housing 210.

The supply path 212 and the mixing path 214 extend in the apparatus depth direction, and the supply path 212 and the mixing path 214 are arranged in the apparatus width direction in this order from a side closer to the developing roller 240.

Specifically, except for both end portions of the supply path 212 and the mixing path 214 in the apparatus depth direction, a partition member 216 that partitions the housing 210 into the supply path 212 and the mixing path 214 extends in the apparatus depth direction.

The upper side of the supply path 212 is opened, and the supply auger 250 that transports the developer G from a front side in the apparatus depth direction to a back side in the apparatus depth direction while rotating is arranged in the supply path 212 to extend in the apparatus depth direction. In addition, the upper side of the mixing path 214 is opened, and the mixing auger 260 that transports the developer G from the back side in the apparatus depth direction to the front side in the apparatus depth direction while rotating is arranged in the mixing path 214 to extend in the apparatus depth direction.

Figure 5:
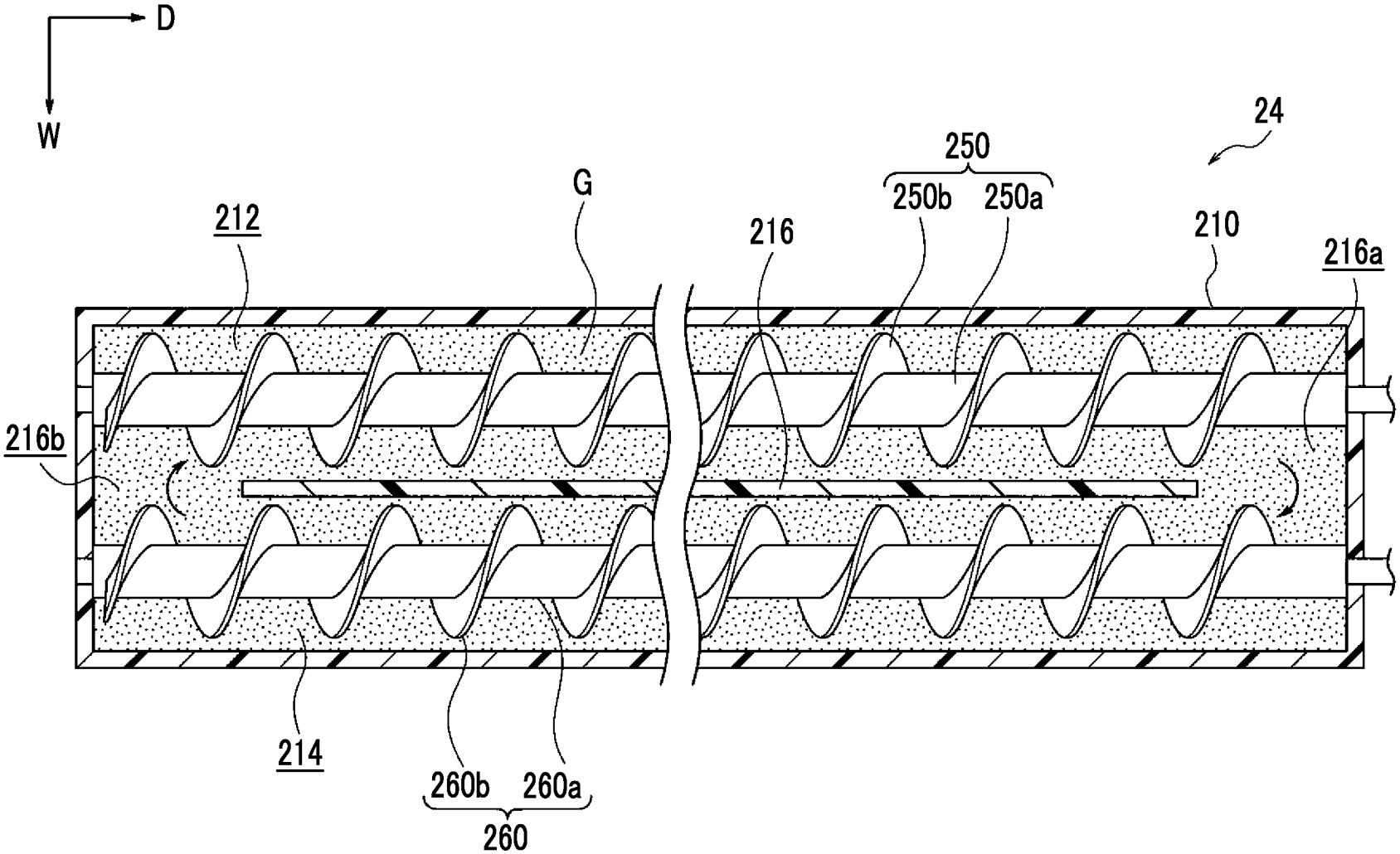
FIG. 5 is a cross-sectional view illustrating the supply auger and a mixing auger of the developing device according to the exemplary embodiment of the present invention.

Further, as illustrated in FIG. 5, a movement path 216*a* that allows the developer G to move between the supply path 212 and the mixing path 214 is formed on the back side of the partition member 216 in the apparatus depth direction with respect. In addition, a movement path 216*b* that allows the developer G to move between the supply path 212 and the mixing path 214 is formed on the front side of the partition member 216 in the apparatus depth direction.

Further, as illustrated in FIG. 3, a relay space 220 that relays the developer G being supplied from the supply auger 250 to the developing roller 240 is formed at a central portion of the housing 210 in the up-and-down direction, that is, a portion above the supply path 212. The pumping roller 270 of which an axial direction is the apparatus depth direction is arranged in the relay space 220 to extend in the apparatus depth direction. In addition, a guide path 228 that guides the developer G, which is released from the pumping roller 270, to the developing roller 240 is formed in the relay space 220. Details of the guide path 228 will be described later.

Further, a collection path 222 through which the developer G scraped off the developing roller 240 is collected to the mixing path 214 is formed at a portion above the mixing path 214 in the housing 210 to extend in the apparatus depth direction. The collection path 222 is separated from the relay space 220 by a separation wall 218 of which a base end is connected to an upper end of the partition member 216.

The separation wall 218 extends upward from a tip of the partition member 216, and bends at an intermediate portion. A tip of the separation wall 218 faces, in the apparatus width direction, an outer circumferential surface of the developing roller 240. Further, a layer thickness regulating member 238 that regulates a layer thickness of the developer G transported by the pumping roller 270 is formed on the separation wall 218 to protrude to a developer regulating pole S2 side of the pumping roller 270, which is to be described later. A distance between a tip 238*a* of the layer thickness regulating member 238 and an outer circumferential surface of the pumping roller 270 is the same in the apparatus depth direction.

In addition, a regulating plate 224 that regulates the layer thickness of the developer G transported by the developing roller 240 is formed on a portion of the housing 210, which faces a lower end of the developing roller 240 in the up-and-down direction. The regulating plate 224 has a plate shape of which a plate surface faces the apparatus width direction, and extends in the apparatus depth direction. A distance between a tip 224*a* of the regulating plate 224 and the outer circumferential surface of the developing roller 240 is the same in the apparatus depth direction.

Developing Roller 240 and Scraping Blade 248

The developing roller 240 is arranged to extend in the apparatus depth direction with the axial direction thereof set to the apparatus depth direction, and includes, as illustrated in FIG. 3, a conductive cylindrical sleeve 240*a* rotatably supported by the housing 210 and a columnar magnet roller 240*b* that is fixed to the housing 210. A gear (not illustrated) is fixed to an end portion of the sleeve 240*a*, a rotational force is transmitted from a drive source to the gear, and the sleeve 240*a* rotates in an arrow R1 direction in the drawing via the gear.

The scraping blade 248 has a plate shape, and is arranged to extend in the apparatus depth direction. An end portion of the scraping blade 248 comes into contact with a portion of the developing roller 240, which faces the collection path 222.

In the configuration, the developing roller 240 attracts the carrier C included in the developer G with a magnetic force and transports the developer. In addition, the regulating plate 224 regulates the layer thickness of the developer G transported by the developing roller 240. Further, the developing roller 240 transports the developer G, of which the layer thickness is regulated, to a position facing the image holder 21. Then, an electrostatic latent image formed on the image holder 21 is visualized as a toner image by the developer G on the developing roller 240.

Further, the scraping blade 248 scrapes the developer G, which remains on the developing roller 240 without being handed over to the electrostatic latent image formed on the image holder 21, off the developing roller 240. Then, the developer G scraped by the scraping blade 248 is collected to the mixing path 214 through the collection path 222.

Supply Auger 250

As illustrated in FIG. 5, the supply auger 250 is arranged in the supply path 212. The supply auger 250 has a supply shaft 250*a* extending in the apparatus depth direction and a spiral supply blade 250*b* formed on a circumferential surface of the supply shaft 250*a*. In addition, both end portions of the supply shaft 250*a* are rotatably supported by a wall portion of the housing 210, and the gear (not illustrated) to which a rotational force is transmitted from the drive source is fixed to one end portion of the supply shaft 250*a*.

Mixing Auger 260

As illustrated in FIG. 5, the mixing auger 260 is arranged in the mixing path 214. The mixing auger 260 has a mixing shaft 260*a* extending in the apparatus depth direction and a spiral mixing blade 260*b* formed on a circumferential surface of the mixing shaft 260*a*. In addition, both end portions of the mixing shaft 260*a* are rotatably supported by the wall portion of the housing 210, and the gear (not illustrated) to which a rotational force is transmitted from the drive source is fixed to one end portion of the mixing shaft 260*a*.

In the configuration, the rotating supply auger 250 transports the developer G in the supply path 212 from the front side in the apparatus depth direction to the back side in the apparatus depth direction. Further, the rotating supply auger 250 hands over the developer G to the mixing auger 260 arranged in the mixing path 214 through the movement path 216*a* formed on the back side in the apparatus depth direction.

The rotating mixing auger 260 transports the developer G, which is handed over from the supply auger 250 through the movement path 216*a*, from the back side in the apparatus depth direction to the front side in the apparatus depth direction while mixing. Further, the rotating mixing auger 260 hands over the developer G to the supply auger 250 arranged in the supply path 212 through the movement path 216*b* formed on the front side in the apparatus depth direction. In this manner, the developer G circulates between the supply path 212 and the mixing path 214 (refer to the arrows in the drawing).

Pumping Roller 270

As illustrated in FIG. 3, the pumping roller 270 is arranged in the relay space 220 formed above the supply path 212. Specifically, in a case of being viewed from the apparatus depth direction, the pumping roller 270 is arranged above the supply auger 250 arranged in the supply path 212, that is on an opposite side to the image holder 21 with the developing roller 240 interposed therebetween in the apparatus width direction. An upper end of the pumping roller 270 is positioned above the lower end of the developing roller 240 in the up-and-down direction. Further, an axial center C1 of the pumping roller 270 is positioned below the lower end of the developing roller 240 in the up-and-down direction.

The pumping roller 270 extends in the apparatus depth direction with an axial direction thereof set to the apparatus depth direction, and includes a conductive cylindrical sleeve 270*a* rotatably supported by the housing 210 and a columnar magnet roller 270*b* that is fixed to the housing 210. The gear (not illustrated) is fixed to an end portion of the sleeve 270*a*, a rotational force is transmitted from the drive source to the gear, and the sleeve 270*a* rotates in an arrow R2 direction (a direction in which an upper portion of the rotating sleeve 270*a* approaches the developing roller 240) in the drawing via the gear. The sleeve 270*a* is an example of a rotation member.

As illustrated in FIG. 1, five magnetic poles in which an S pole or an N pole is formed on a surface side of the sleeve 270*a* along the circumferential direction are arranged at intervals inside the magnet roller 270*b*.

A pumping pole S1 for pumping the developer G from the supply path 212 is arranged at a position facing the supply auger 250 in the up-and-down direction. In addition, a transporting pole N1 for transporting the developer G, which is next to the pumping pole S1 along a rotation direction of the sleeve 270*a*, a developer regulating pole S2 for regulating the layer thickness of the developer G, a transporting pole N2 for transporting the developer G, and a peeling pole S3 for peeling the developer G from the sleeve 270*a* are arranged in this order. The pumping pole S1, the developer regulating pole S2, and the peeling pole S3 are S-poles, and the transporting pole N1 and the transporting pole N2 are N-poles.

The developer regulating pole S2 is arranged on a separation wall 218 side of the axial center C1 of the pumping roller 270 in the apparatus width direction and to face the layer thickness regulating member 238. In addition, the peeling pole S3 is arranged on a developing roller 240 side of the axial center C1.

Figure 2:
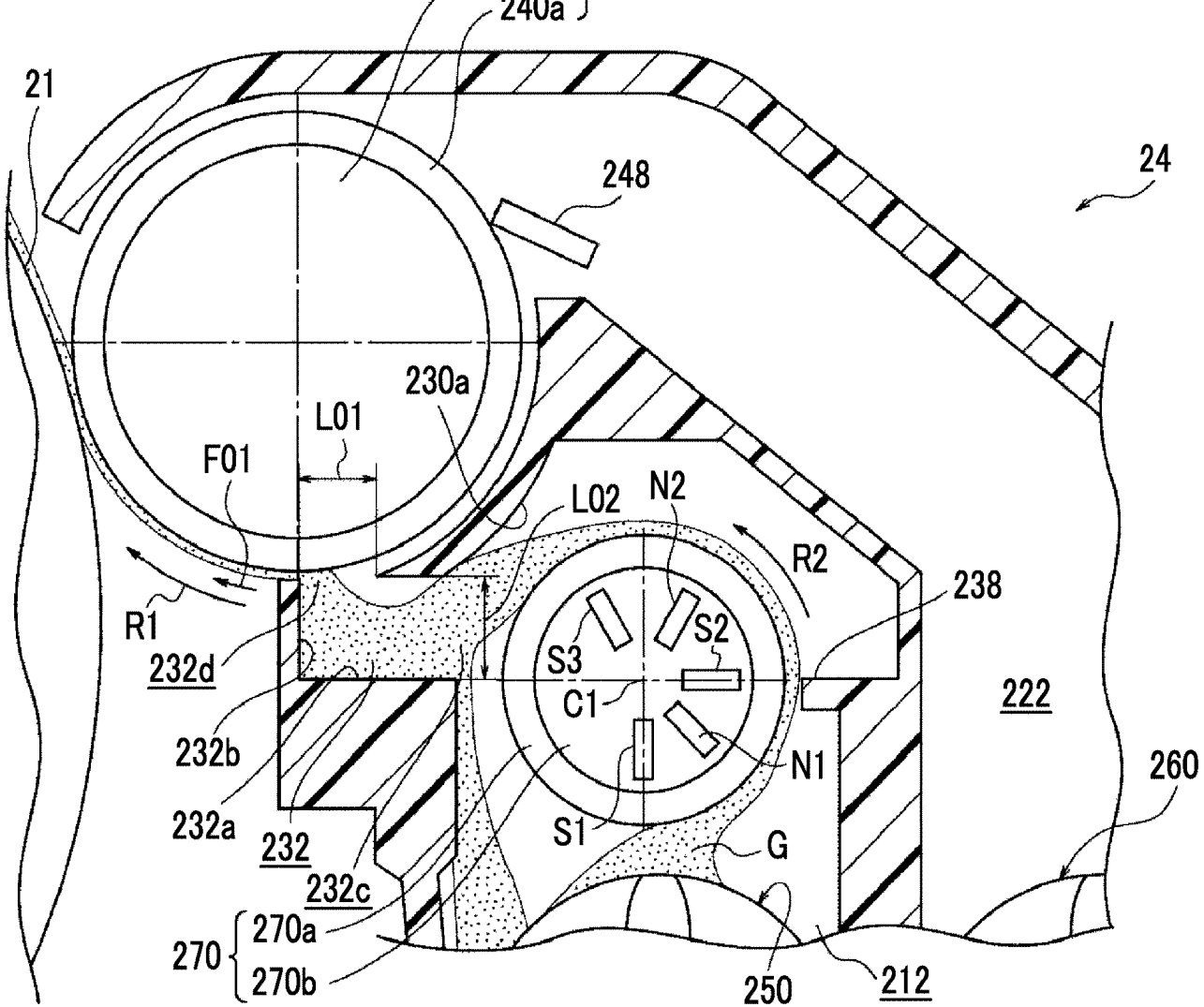
FIG. 2 is an enlarged sectional view illustrating the developing device according to the exemplary embodiment of the present invention.

In the configuration, in a case where the sleeve 270*a* rotates in the arrow R2 direction, the pumping pole S1 pumps the developer G, which is transported by the supply auger 250 in the supply path 212, to the sleeve 270*a* with a magnetic force, as illustrated in FIG. 2. The developer G pumped by the pumping pole S1 is transported to the transporting pole N1, the developer regulating pole S2, the transporting pole N2, and the peeling pole S3 in this order as the sleeve 270*a* rotates in the arrow R2 direction.

In a case where the developer G passes through the developer regulating pole S2, the layer thickness regulating member 238 formed on the separation wall 218 regulates the layer thickness of the developer G by coming into contact with the developer G. Further, the peeling pole S3 peels and releases the developer G, of which the layer thickness is regulated, from the sleeve 270*a*. Specifically, the pumping roller 270 releases the developer G, which is to be supplied to the developing roller 240, in a tangential direction of the rotating sleeve 270*a*.

Guide Path 228

Next, the guide path 228 that guides the developer G, which is released from the pumping roller 270, to the developing roller 240 will be described. As illustrated in FIG. 1, the guide path 228 is formed in the relay space 220 of the housing 210 by a partition surface 230*a*, a bottom surface 232*a*, and a side surface 232*b*.

The partition surface 230*a* is formed on a partition plate 230. In a case of being viewed from the apparatus depth direction, the partition plate 230 is arranged between the pumping roller 270 and the developing roller 240, and has an arc shape along the outer circumferential surface of the developing roller 240. In addition, a lower end of the partition plate 230 extends until matching the position of lower end of the developing roller 240 in the up-and-down direction, and is spaced apart from the tip 224*a* of the regulating plate 224 in the apparatus width direction. Further, an upper end of the partition plate 230 extends to an upper end of the separation wall 218. A surface of the partition plate 230, which faces the pumping roller 270 side, is the partition surface 230*a*. Further, a lower surface 230*b*, which faces downward, is formed on the lower end of the partition plate 230.

As the partition plate 230 is arranged, the developer G released in the tangential direction of the sleeve 270*a* comes into contact with the partition surface 230*a* of the partition plate 230 and is not directly supplied to the developing roller 240. In this manner, the partition plate 230 functions as a preventing member that prevents the developer G released in the tangential direction of the sleeve 270*a* from being directly supplied to the developing roller 240.

The bottom surface 232*a* is arranged below the developing roller 240, and faces upward so that the bottom surface faces the developing roller 240 in the up-and-down direction. In addition, the bottom surface 232*a* has a rectangular shape extending in the apparatus depth direction in a case of being viewed from above. Further, the bottom surface 232*a* is spaced apart from the lower surface 230*b* of the partition plate 230 in up-and-down direction, and an edge portion 233 of the bottom surface 232*a* on the pumping roller 270 side is spaced apart from the pumping roller 270 in the apparatus width direction. In addition, in a case of being viewed from above, a part of the bottom surface 232*a* overlaps the lower surface 230*b*. Between the edge portion 233 and the lower surface 230*b* of the partition plate 230, there is a receiving port 232*c* that faces an upper portion of the pumping roller 270 in the apparatus width direction and receives the developer G in a passing region 232 to be described later.

As the bottom surface 232*a* is arranged, some of the developer G released in the tangential direction of the sleeve 270*a* passes through the receiving port 232*c* and abuts against the bottom surface 232*a*. Then, some of the developer G placed on the bottom surface 232*a* stops temporarily, and faces the developing roller 240 in the up-and-down direction. In this manner, the bottom surface 232*a* functions as a facing member that causes the developer G, which has passed through the receiving port 232*c*, to face the developing roller 240 in the up-and-down direction.

The side surface 232*b* is formed on the plate-shaped regulating plate 224. Specifically, a surface of the regulating plate 224, which faces the pumping roller 270 side, is the side surface 232*b*, and the side surface 232*b* has a rectangular shape extending in the apparatus depth direction in a case of being viewed from the apparatus width direction. Further, a lower end of the side surface 232*b* is connected to an edge portion of the bottom surface 232*a* on the opposite side to the edge portion 233.

In a case of being viewed from the apparatus depth direction, a rectangular region, which is above the bottom surface 232*a* and is to the side of the side surface 232*b*, is the passing region 232 through which the developer G to be supplied to the developing roller 240 passes. In addition, between an upper end of the side surface 232*b* and the lower surface 230*b* of the partition plate 230, there is a supply port 232*d* through which the developer G to be supplied from the passing region 232 to the developing roller 240 passes. In other words, the supply port 232*d* opens the passing region 232 in an intersecting direction that intersects a direction in which the passing region 232 is opened by the receiving port 232*c*, in a case of being viewed from the apparatus depth direction.

Herein, in the present exemplary embodiment, an opening width (L01 of FIG. 2) of the supply port 232*d* is smaller than an opening width (L02 of FIG. 2) of the receiving port 232*c*. In other words, the opening width L02 of the receiving port 232*c* is greater than the opening width L01 of the supply port 232*d*.

As the side surface 232*b* is arranged, the developer G placed on the bottom surface 232*a* is blocked and guided to the developing roller 240 side. In this manner, the side surface 232*b* functions as a blocking member that blocks the developer G placed on the bottom surface 232*a*.

In the configuration, as illustrated in FIG. 2, the developer G released in the tangential direction of the rotating sleeve 270*a* passes through the receiving port 232*c* and flows into the passing region 232. The developer G flowed in the passing region 232 passes through the supply port 232*d* and is supplied to the developing roller 240. In this manner, the developer G released in the tangential direction of the rotating sleeve 270*a* changes a flowing direction thereof and is supplied to the developing roller 240.

In other words, the guide path 228 guides the developer G, which is released in the tangential direction of the rotating sleeve 270*a*, below the developing roller 240, changes the flowing direction of the developer G guided below the developing roller 240, and guides the developer G to a lower portion of the developing roller 240. In this manner, a changing unit 226 that changes the flowing direction of the developer G is formed to include the guide path 228.

Action of Major Portion Configuration

Next, the action of a major portion configuration will be described while comparing to a developing device 424 according to a comparative example. First, a configuration of the developing device 424 according to the comparative example will be described focusing on portions different from the developing device 24.

Developing Device 424

Figure 11:
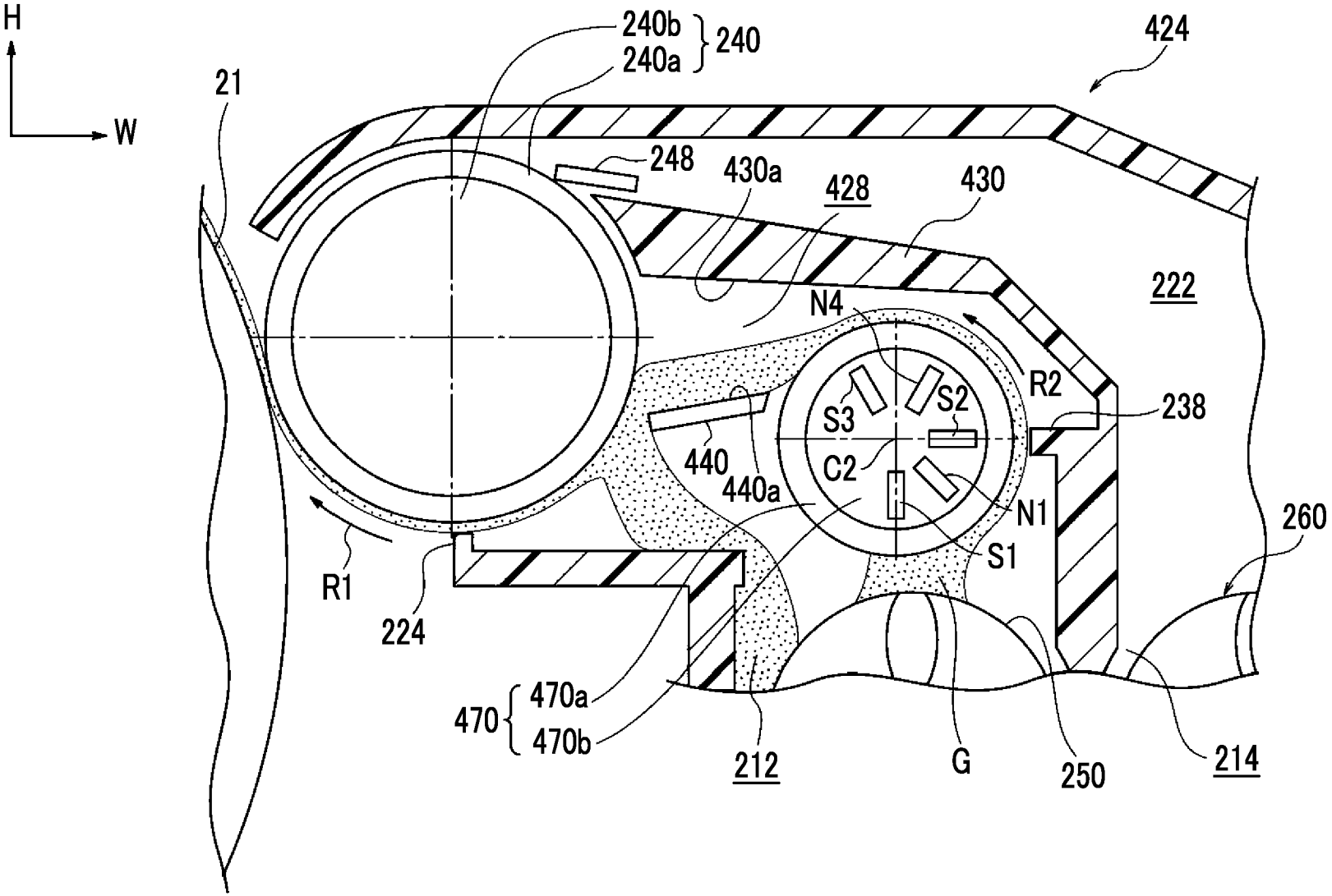
FIG. 11 is an enlarged sectional view illustrating a developing device according to a comparative example of the exemplary embodiment of the present invention.

As illustrated in FIG. 11, in a case of being viewed from the apparatus depth direction, a pumping roller 470 included in the developing device 424 is arranged above the supply auger 250 arranged in the supply path 212, that is on the opposite side to the image holder 21 with the developing roller 240 interposed therebetween in the apparatus width direction. An upper end of the pumping roller 470 is positioned above the lower end of the developing roller 240 in the up-and-down direction. Further, an axial center C2 of the pumping roller 470 is positioned above the lower end of the developing roller 240 in the up-and-down direction.

The pumping roller 470 faces the lower portion of the developing roller 240 in the apparatus width direction, and includes a sleeve 470*a* and a magnet roller sleeve 470*b*. The pumping roller 470 is different from the pumping roller 270 only in terms of an arranged position, and is the same as the pumping roller 270 for other configurations.

A guide path 428 that guides the developer G, which is released from the pumping roller 470, to the developing roller 240 is formed to include a partition surface 430*a* and a guide surface 440*a*.

The partition surface 430*a* is formed on a partition plate 430. The partition plate 430 is arranged above the pumping roller 470 to partition the inside into the guide path 428 and the collection path 222 in the up-and-down direction, and a surface of the partition plate 430, which faces a pumping roller 470 side, is the partition surface 430*a*.

The guide surface 440*a* is formed on a guide plate 440. In a case of being viewed from the apparatus depth direction, the guide plate 440 is arranged between the developing roller 240 and the pumping roller 470, and extends in the apparatus depth direction. Specifically, in a case of being viewed from the apparatus depth direction, the guide plate 440 is inclined such that the developing roller 240 side is positioned below the pumping roller 470 side. In addition, an edge portion of the guide plate 440 on the pumping roller 470 side is positioned, in the up-and-down direction, below the upper end of the pumping roller 470 and above the axial center C2 of the pumping roller 470. A surface of the guide plate 440, which faces upward, is the guide surface 440*a*.

Action of Developing Devices 24 and 424

The rotating supply auger 250 and the rotating mixing auger 260 transport the developer G while mixing, as illustrated in FIG. 5. Accordingly, the developer G circulates between the supply path 212 and the mixing path 214. Herein, the developer G transported by the supply auger 250 turns back on the back side in the apparatus depth direction, and is handed over to the mixing auger 260.

Figure 4:
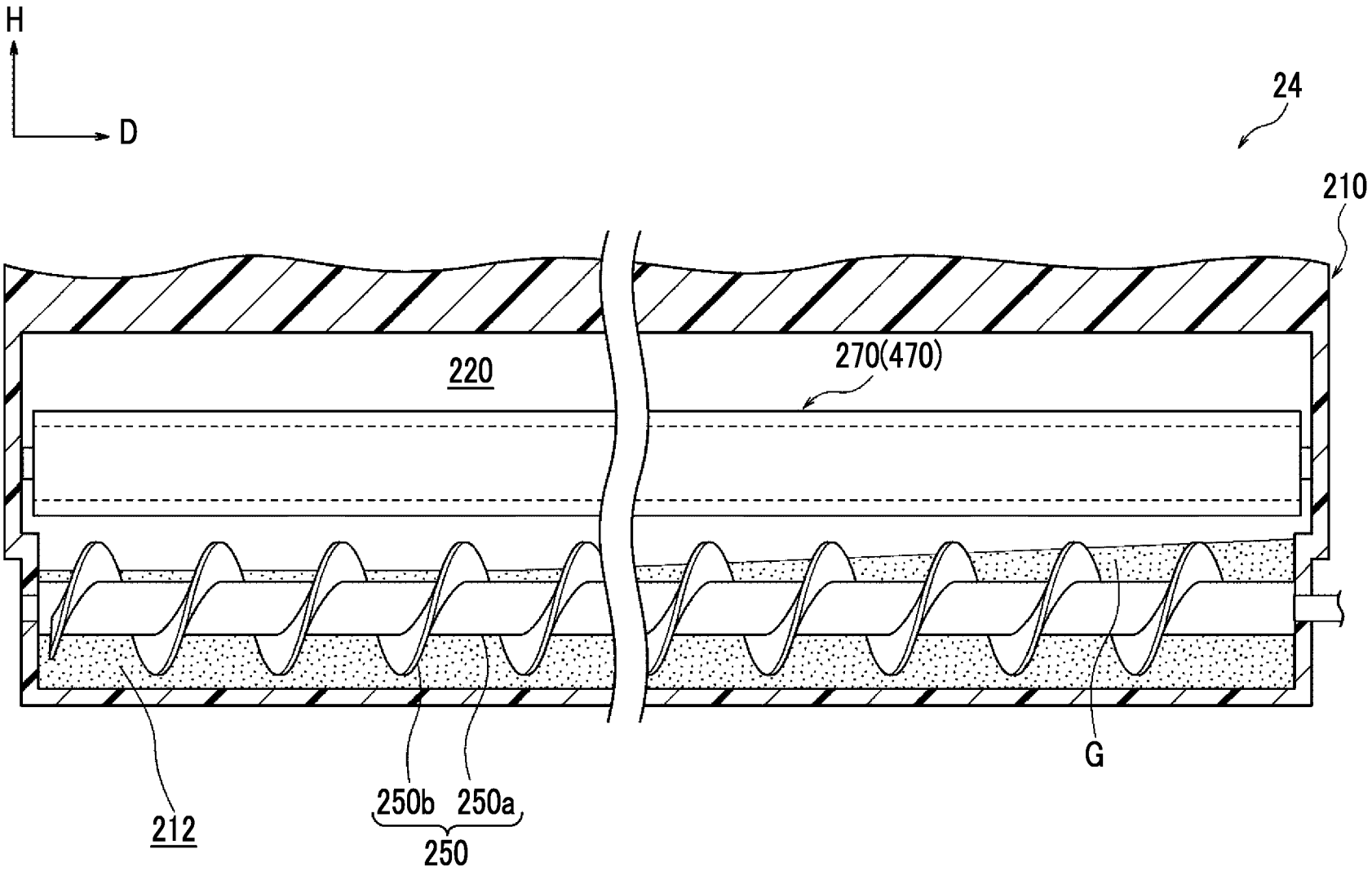
FIG. 4 is a sectional view illustrating a pumping roller and a supply auger of the developing device according to the exemplary embodiment of the present invention.

For this reason, a force restricting movement in the apparatus depth direction acts on a portion of the developer G in the supply path 212, which is on the back side in the apparatus depth direction. As illustrated in FIG. 4, the height of the developer G in the supply path 212 increases from the front side toward the back side in the apparatus depth direction. In other words, the surface of the developer G in the supply path 212 comes closer to the pumping rollers 270 and 470 from the front side toward the back side in the apparatus depth direction.

In addition, as illustrated in FIGS. 2 and 11, the pumping rollers 270 and 470 pump the developer G, which is transported by the supply auger 250 while being mixed, to the sleeves 270*a* and 470*a* with the pumping pole S1. Herein, as described above, the surface of the developer G in the supply path 212 is closer to the pumping rollers 270 and 470 from the front side toward the back side in the apparatus depth direction. For this reason, the amount of the developer G pumped to a portion of each of the sleeves 270*a* and 470*a* on the back side in the apparatus depth direction is larger than the amount of the developer G pumped to a portion on the front side in the apparatus depth direction. In other words, the amount of the developer G pumped to each of the sleeves 270*a* and 470*a* varies in the apparatus depth direction.

The developer G pumped to the sleeves 270*a* and 470*a*, which rotate in the arrow R2 direction, is transported to the transporting pole N1, the developer regulating pole S2, the transporting pole N2, and the peeling pole S3 in this order. In a case where the developer G passes through the developer regulating pole S2, the layer thickness regulating member 238 regulates the layer thickness of the developer G by coming into contact with the developer G. Further, the peeling pole S3 peels and releases the developer G, of which the layer thickness is regulated, from the sleeves 270*a* and 470*a*. Specifically, the pumping rollers 270 and 470 release the developer G, which is to be supplied to the developing roller 240, in the tangential directions of the rotating sleeves 270*a* and 470*a* respectively.

Hereinafter, a process of supplying the developer G, which is released in the tangential direction of each of the sleeves 270*a* and 470*a*, to the developing roller 240 will be described separately for the developing device 424 and the developing device 24, respectively.

Developing Device 424

As illustrated in FIG. 11, the axial center C2 of the pumping roller 470 included in the developing device 424 is positioned above the lower end of the developing roller 240 in the up-and-down direction as described above. In addition, the pumping roller 470 faces the lower portion of the developing roller 240 in the apparatus width direction. Further, the guide path 428 that guides the developer G, which is released from the pumping roller 470, to the developing roller 240 is formed to include the guide surface 440*a*.

For this reason, the developer G released in the tangential direction of the sleeve 470*a* is guided by the guide surface 440*a* without the flowing direction thereof being changed forcibly, and is supplied to the developing roller 240. The surplus developer that is guided by the guide surface 440*a* but not supplied to the developing roller 240 falls downward from a gap between the guide surface 440*a* and the developing roller 240, and is returned to the supply path 212.

The developing roller 240 receives the developer G supplied from the pumping roller 470 with a magnetic force of the magnet roller 240*b*, and transports the developer G with the rotating sleeve 240*a*. The transported developer G comes into contact with the regulating plate 224 so that the layer thickness thereof is regulated, and is handed over to the image holder 21.

Accordingly, an electrostatic latent image formed on the image holder 21 is developed. In addition, the developer G remaining on the sleeve 240*a* without being handed over to the image holder 21 is scraped off the sleeve 240*a* by the scraping blade 248, and is collected to the mixing path 214 through the collection path 222.

Developing Device 24

As illustrated in FIG. 1, the axial center C1 of the pumping roller 270 included in the developing device 24 is positioned below the lower end of the developing roller 240 in the up-and-down direction as described above. In addition, the guide path 228 that guides the developer G, which is released from the pumping roller 270, to the developing roller 240 is formed to include the partition surface 230*a*, the bottom surface 232*a*, and the side surface 232*b*.

For this reason, as illustrated in FIG. 2, some of the developer G released in the tangential direction of the sleeve 270*a* comes into contact with the partition surface 230*a* so that the flowing direction thereof is changed forcibly, passes through the receiving port 232*c*, and flows into the passing region 232. On the other hand, the rest of the developer G released in the tangential direction of the sleeve 270*a* flows from the receiving port 232*c* into the passing region 232 without the flowing direction thereof being changed forcibly. The surplus developer G, which is released in the tangential direction of the sleeve 270*a* but has not passed through the receiving port 232*c*, falls downward from a gap between the bottom surface 232*a* and the pumping roller 270, and is returned to the supply path 212.

The developer G flowed in the passing region 232 is blocked by the side surface 232*b*, and abuts against the bottom surface 232*a*. The developer G placed on the bottom surface 232*a* is guided by the side surface 232*b* to the developing roller 240 side arranged above. As described above, as the developer G is blocked by the side surface 232*b*, the flowing direction of the developer G is changed forcibly.

Then, the developer G guided to the developing roller 240 side passes through the supply port 232*d* and is supplied to the developing roller 240 with assistance by a magnetic force of the magnet roller 240*b* of the developing roller 240. The surplus developer G, which has passed through the receiving port 232*c* and has flowed in the passing region 232 but is not supplied to the developing roller 240, passes through the receiving port 232*c* in an opposite direction thereto, falls downward from the gap between the bottom surface 232*a* and the pumping roller 270, and is returned to the supply path 212. Alternatively, the surplus developer G stays in the passing region 232.

In this manner, the developer G released in the tangential direction of the rotating sleeve 270*a* changes the flowing direction thereof and is supplied to the developing roller 240 side arranged above. In other words, the guide path 228 guides the developer G, which is released in the tangential direction of the rotating sleeve 270*a*, below the developing roller 240, changes the flowing direction of the developer G guided below the developing roller 240, and supplies the developer G to the lower portion of the developing roller 240. Further, in other words, the developer G released in the tangential direction of the rotating sleeve 270*a* passes through the receiving port 232*c*, flows into the passing region 232, passes through the supply port 232*d* that opens the passing region 232 in a direction different from the direction of the receiving port 232*c*, and is supplied to the developing roller 240.

Then, the developing roller 240 transports the pumped developer G with the rotating sleeve 240*a*. Specifically, the rotating sleeve 240*a* transports the developer G supplied from the pumping roller 270 in a direction away from the pumping roller 270. Further, the transported developer G comes into contact with the regulating plate 224 so that the layer thickness thereof is regulated, and is handed over to the image holder 21. Accordingly, an electrostatic latent image formed on the image holder 21 is developed. In addition, the developer G remaining on the sleeve 240*a* without being handed over to the image holder 21 is scraped off the sleeve 240*a* by the scraping blade 248, and is collected to the mixing path 214 through the collection path 222.

Outline

As described hereinbefore, in the developing device 24 illustrated in FIG. 1, the developer G released in the tangential direction of the sleeve 270*a* is supplied to the developing roller 240 with the flowing direction thereof being changed forcibly against the gravity direction. On the other hand, in the developing device 424 illustrated in FIG. 11, the developer G released in the tangential direction of the sleeve 470*a* is supplied to the developing roller 240 without the flowing direction thereof being changed forcibly against the gravity direction.

Herein, as described above, the amount of the developer G pumped to each of the sleeves 270*a* and 470*a* varies in the apparatus depth direction. Thus, in the developing device 24, the developer G released in the tangential direction of the sleeve 270*a* is supplied to the developing roller 240 after the flowing direction thereof being changed forcibly against the gravity direction. As the flowing direction of the developer G is changed forcibly against the gravity direction as described above, the developer G is supplied to the developing roller 240 in a state where variations in the developer G in the apparatus depth direction are alleviated in the developing device 24, compared to a case of using the developing device 424. For this reason, development unevenness that occurs in the apparatus depth direction is suppressed in the developing device 24, compared to the case of using the developing device 424.

In addition, the developing device 24 has the guide path 228 that guides the developer G to the developing roller 240 such that the flowing direction of the developer G, which is released in the tangential direction of the sleeve 270*a* and is to be supplied to the developing roller 240, is changed. For this reason, for example, unlike a case where the flowing direction of the developer G is changed forcibly by a wind pressure, the flowing direction of the developer G is changed forcibly against the gravity direction without using power.

In addition, in the developing device 24, the guide path 228 guides the developer G, which is released in the tangential direction of the rotating sleeve 270*a*, below the developing roller 240, changes the flowing direction of the developer G, and guides the developer G to the lower portion of the developing roller 240. Accordingly, the developer G guided to the lower portion of the developing roller 240 needs to move upward against gravity.

For this reason, compared to a case where the developer G moves without being against gravity and is guided to the developing roller 240 as in the developing device 424, the developer G moves in the apparatus depth direction, and variations in the developer G, which is guided to the developing roller 240, in the apparatus depth direction are alleviated. Accordingly, development unevenness that occurs in the apparatus depth direction is suppressed in the developing device 24, compared to a case where the developer G moves without being against gravity and is guided to the developing roller 240 as in the developing device 424.

Figure 10:
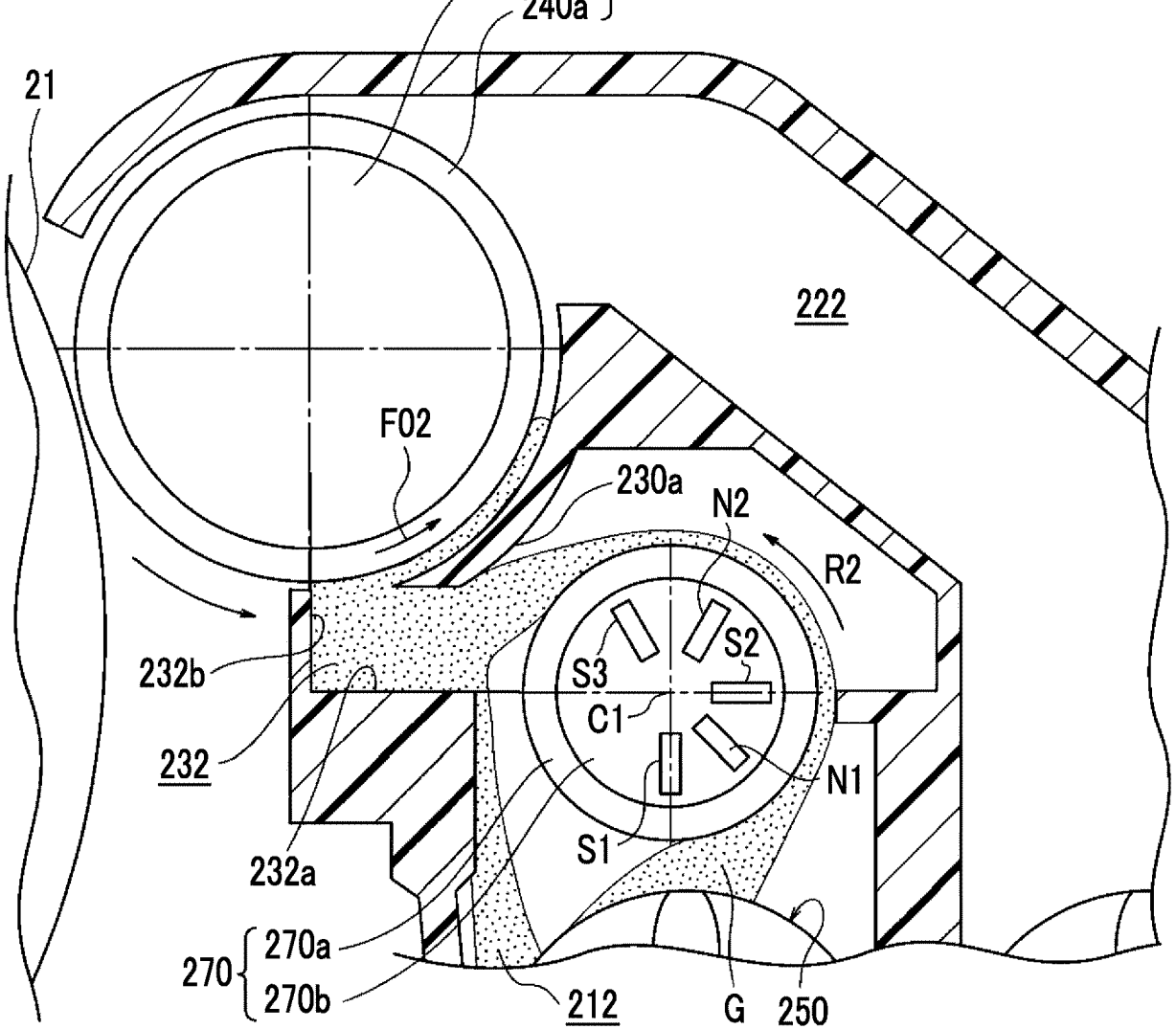
FIG. 10 is an enlarged sectional view illustrating a developing device according to a modification example of the exemplary embodiment of the present invention.

In addition, in the developing device 24, the rotating sleeve 240*a* transports the developer G, which is supplied from the pumping roller 270, in the direction away from the pumping roller 270 (an arrow F01 of FIG. 2). For this reason, for example, since the developer G does not turn back in a U-shape compared to a case where the sleeve rotates in an opposite direction and the developer G supplied from the pumping roller 270 is transported in a direction (an arrow F02 direction of FIG. 10) coming closer to the pumping roller 270, variations in the developer G supplied to the developing roller 240 in the apparatus depth direction are alleviated. Accordingly, development unevenness that occurs in the apparatus depth direction is suppressed compared to a case where the developing roller transports the developer G supplied from the pumping roller 270 in the direction coming closer to the pumping roller 270.

In addition, in the developing device 24, the developer G released in the tangential direction of the rotating sleeve 270*a* passes through the receiving port 232*c*, flows into the passing region 232, passes through the supply port 232*d* that opens the passing region 232 in the direction different from the direction of the receiving port 232*c*, and is supplied to the developing roller 240.

For this reason, for example, unlike a case where the flowing direction of the developer G is changed forcibly by a wind pressure, the flowing direction of the developer G is changed forcibly without using power.

In addition, in the developing device 24, the opening width L02 of the receiving port 232*c* is greater than the opening width L01 of the supply port 232*d*. For this reason, compared to a case where the opening width of the receiving port is smaller than the opening width of the supply port, the insufficiency of the developer G that passes through the supply port 232*d* and is supplied to the developing roller 240 is suppressed. Accordingly, in the developing device 24, development unevenness that occurs in the apparatus depth direction is suppressed, compared to a case where the opening width of the receiving port is smaller than the opening width of the supply port.

In addition, in the developing device 24, the supply port 232*d* is formed below the developing roller 240. For this reason, the developer G, which has passed through the supply port 232*d* and is to be guided to the lower portion of the developing roller 240, needs to move upward against gravity.

For this reason, compared to a case where the developer G moves without being against gravity and is guided to the developing roller 240 as in the developing device 424, variations in the developer G, which is guided to the developing roller 240, in the apparatus depth direction are alleviated. Accordingly, development unevenness that occurs in the apparatus depth direction is suppressed in the developing device 24, compared to a case where the developer G moves without being against gravity and is guided to the developing roller 240 as in the developing device 424.

In addition, as the image forming apparatus 10 includes the developing device 24, the quality reduction of an output image is suppressed, compared to a case of including the developing device 424.

Although details of a certain exemplary embodiment of the present invention has been described, the present invention is not limited to such an exemplary embodiment, and it is clear for those skilled in the art that adopting other various exemplary embodiments within the scope of the present invention is possible. For example, although the flowing direction of the developer G has changed as the developer G flows in the guide path 228 in the exemplary embodiment, the flowing direction of the developer G may be changed by a wind pressure or a magnetic force. However, in this case, as the developer G flows in the guide path 228, action that occurs due to a change in the flowing direction of the developer G does not occur.

In addition, although the developer G, which is guided to the lower portion of the developing roller 240, has moved upward against gravity in the exemplary embodiment, the flowing direction of the developer G to be supplied to the developing roller 240 need only change, and the developer may not flow against gravity. However, in this case, action that occurs as the developer G moves upward against gravity does not occur.

In addition, although not particularly described in the exemplary embodiment, the developer G is moved in the apparatus depth direction by forming the bottom surface 232*a* into an uneven shape extending in the apparatus depth direction and generating a frictional force between the developer G flowed in the passing region 232 and the bottom surface 232*a*, and thus variations in the developer G in the apparatus depth direction may be alleviated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a transporting member that transports a developer in an axial direction while rotating;

a developing roller that hands over the developer to an image holder, on which an electrostatic latent image is formed, while rotating, and develops the electrostatic latent image;

a pumping roller that has a rotation member rotating in a circumferential direction, pumps the developer transported by the transporting member with a magnetic force, and supplies the pumped developer to the developing roller by releasing the developer in a tangential direction of the rotating rotation member; and a changing unit comprising a guide path that changes a flowing direction of the developer, which is released in the tangential direction of the rotating rotation member and is to be supplied to the developing roller, wherein an upper end of the pumping roller is positioned above a lower end of the developing roller in an up-and-down direction.

2. The developing device according to claim 1, wherein the changing unit has the guide path that guides the developer to the developing roller such that the flowing direction of the developer, which is released in the tangential direction of the rotating rotation member and is to be supplied to the developing roller, is changed.

3. The developing device according to claim 2, wherein in a case of being viewed from the axial direction, the pumping roller is arranged at a position different from the developing roller in a horizontal direction, and the guide path guides the developer, which is released in the tangential direction of the rotating rotation member, below the developing roller, changes the flowing direction of the developer guided below the developing roller, and guides the developer to a lower portion of the developing roller.

4. The developing device according to claim 3, wherein the rotating developing roller transports the developer supplied from the pumping roller in a direction away from a pumping roller side without turning back.

5. The developing device according to claim 1, wherein the changing unit includes a passing region through which the developer to be supplied to the developing roller passes, a receiving port that receives the developer, which is released in the tangential direction of the rotating rotation member, into the passing region, and a supply port that in a case of being viewed from the axial direction, opens the passing region in an intersecting direction, which intersects a direction in which the passing region is opened by the receiving port, and allows the developer, which is supplied from the passing region to the developing roller, to pass therethrough.

6. The developing device according to claim 5, wherein an opening width of the receiving port is greater than an opening width of the supply port.

7. The developing device according to claim 6, wherein in a case of being viewed from the axial direction, the pumping roller is arranged at a position different from the developing roller in a horizontal direction, and the supply port is formed below the developing roller.

8. The developing device according to claim 7, wherein the rotating developing roller transports the developer supplied from the pumping roller in a direction away from a pumping roller side without turning back.

9. The developing device according to claim 5, wherein in a case of being viewed from the axial direction, the pumping roller is arranged at a position different from the developing roller in a horizontal direction, and the supply port is formed below the developing roller.

10. The developing device according to claim 9, wherein the rotating developing roller transports the developer supplied from the pumping roller in a direction away from a pumping roller side without turning back.

11. An image forming apparatus comprising:

the image holder on which an electrostatic latent image is formed; and the developing device according to claim 1, that develops the electrostatic latent image formed on the image holder.

* * * * *